US006307514B1

(12) United States Patent
West

(10) Patent No.: US 6,307,514 B1
(45) Date of Patent: Oct. 23, 2001

(54) METHOD AND SYSTEM FOR GUIDING AN ARTILLERY SHELL

(75) Inventor: James B. West, Cedar Rapids, IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 09/564,350

(22) Filed: May 1, 2000

(51) Int. Cl.[7] ..... H01Q 1/28; F41G 7/00; F42B 10/00

(52) U.S. Cl. ..... 343/705; 343/770; 102/384; 244/3.14; 244/3.19; 244/3.24

(58) Field of Search ..... 343/700 MS, 767, 343/769, 770, 705, 708; 244/3.14, 3.19, 3.24, 3.26; 102/214, 384; H01Q 1/38, 13/10

(56) References Cited

U.S. PATENT DOCUMENTS

Re. 29,296 * 7/1977 Krutsinger et al. ..... 343/700 MS
3,475,755 * 10/1969 Bassen et al. ..... 343/705
3,914,767 * 10/1975 Jones ..... 343/769
4,037,540 * 7/1977 Keydel ..... 343/769
4,051,480 * 9/1977 Reggia et al. ..... 343/705
4,305,078 * 12/1981 Jones et al. ..... 343/705
5,434,583 * 7/1995 Hesse et al. ..... 343/705

OTHER PUBLICATIONS

Patent Application entitled "Artillery Fuse Circumferential Slot Antenna For Positioning And Telemetry"; Ser. No. 09/088,353, Filed Jun. 1, 1998 by James B. West.

* cited by examiner

*Primary Examiner*—Michael C. Wimer
(74) *Attorney, Agent, or Firm*—Nathan O. Jensen; Kyle Eppele

(57) ABSTRACT

A system and method for guiding an artillery shell in flight which includes a multi-element antenna having a large central access hole therein for receiving an airfoil actuator pin, the antenna array being switched during flight, as a function of the rotation of the shell, so that the upwardly directed portion of the radiation pattern predominates over a terrestrially directed segment of the radiation pattern.

22 Claims, 3 Drawing Sheets

METHOD AND SYSTEM FOR GUIDING AN ARTILLERY SHELL

CROSS REFERENCE TO RELATED APPLICATIONS

The present invention relates to a U.S. patent application Ser. No. 09/088,353 entitled "Artillery Fuse Circumferential Slot Antenna For Positioning and Telemetry" by James B. West filed on Jun. 1, 1998, now U.S. Pat. No. 6,098,547 which is incorporated herein by reference in its entirety.

FIELD OF THE INVENTION

The present invention generally relates to artillery shells and their fuses, and more particularly relates to antenna systems for use in an artillery shell, and even more particularly relates to methods and systems for guiding and communicating with an artillery shell.

BACKGROUND OF THE INVENTION

Artillery shells typically utilize a fuse installed at the leading end of the shell. The fuse is a mechanical or electronic device designed to control the detonation of the explosive charge of the shell. Modern artillery fuses further include electronics and telemetry systems for improved accuracy and detonation control. The electronic circuits disposed in the fuse remain in radio-frequency contact with a ground station after launch of the shell for coordinating the trajectory of the shell, making course corrections as necessary. Further, the artillery fuse may operate in conjunction with a satellite based positioning system, such as the NAVSTAR global positioning systems (GPS), maintained and operated by the United States government, for accurately determining the coordinates of the shell as it travels along its trajectory and reaches the point of impact, and for correcting the trajectories of subsequently fired munitions. GPS may also be used, as a positional reference, to deploy the flaps, from a previous free fall state, to more accurately control the downward descent to the target.

An artillery fuse having telemetry and positioning system electronics requires an antenna suitable for the application and environment to which an artillery shell is subject. The fuse antenna should be able to survive the extreme acceleration and high rotational velocities typical of gun launched projectiles. Further, the radiation pattern of the antenna should exhibit relatively high gain in the aft direction, the direction opposite to the direction of travel of the shell. The radiation pattern of the antenna should be minimal in the direction of travel of the shell to minimize or prevent jamming from the vicinity of the target area of the shell. Such an antenna should be of a sufficiently reduced size so as not to occupy a large of space within the interior of the fuse, and is desirably designed for operation with L-band and S-band signals. ("L" is the letter designation for microwave signals in the frequency range from 1 to 2 GHz, and "S" is the letter designation for microwave signals in the frequency range from 2–4 GHz.)

One prior art approach is described in the above-referenced patent application. While this design has considerable benefits, it does have some drawbacks. First of all, the size and shape of the antenna prohibit its use with some artillery shells having centrally disposed actuation pins for controlling airfoil surfaces on the artillery shell. The radiation pattern of the antenna is omni-directional in orthogonal directions about the shell trajectory and, therefore, is capable of being jammed from terrestrial positions.

Consequently, there exists a need for improved methods and systems for guiding artillery shells.

SUMMARY OF THE INVENTION

It is an object of the present invention to provide a system and method for guiding an artillery shell.

It is a feature of the present invention to utilize an array of antennas with an open central region.

It is another feature of the present invention to include a switching mechanism to control operation of particular antenna segments as a function of their orientation with respect to the ground.

It is an advantage of the present invention to achieve improved shell control by permitting a centrally disposed airfoil actuation pin to operate in the same cavity as the antenna.

The present invention is an apparatus and method for guiding artillery shells designed to satisfy the aforementioned needs, provide the previously stated objects, include the above-listed features, and achieve the already articulated advantages. The present invention is carried out in a "central obstruction-less" manner in a sense that the amount of centrally disposed obstructions in the artillery shell fuse has been greatly reduced. The present invention is also carried out in a "jam-free" manner in the sense that the susceptibility of the antenna to terrestrial-based jammers has been greatly reduced.

Accordingly, the present invention is a system and method for guiding an artillery shell which includes an array of separately controllable antennas disposed in an artillery shell fuse, with a central region therein which is available for location of an airfoil actuation pin.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
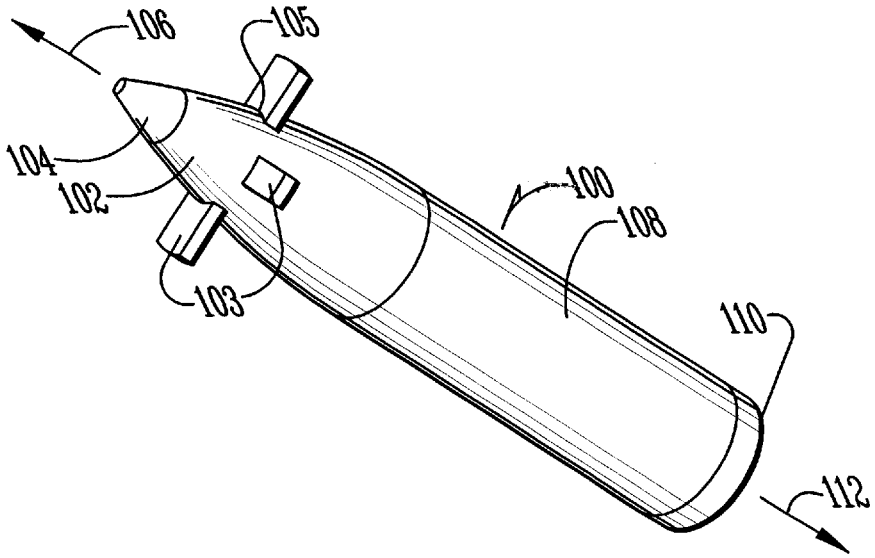
FIG. 1 is a perspective view of an artillery shell of the present invention, which is shown having retractable airfoil flaps in a deployed configuration.

Now referring to the drawings wherein like numerals refer to like matter throughout.

Referring now to FIG. 1, an artillery shell in accordance with the present invention is shown. The artillery shell 100 or similar munition is typically launched or fired from a cannon, mortar, or similar type of gun (not shown). A fuse 104 is disposed at the nose 102 of shell 100 and is typically physically contiguous with the body 108 of shell 100. A fuse, or fuze, is a mechanical or electronic device utilized for detonating an explosive charge, such as the charge of an artillery shell or similar munition. Shell 100, when launched or otherwise projected, travels in a forward direction 106 toward the vicinity of a target. During flight, the rear 110 of shell 100 generally points in the aft direction 112 toward the vicinity of origin of shell 100; i.e. toward the gun from which shell 100 is launched. During flight, retractable airfoil flaps 103 or any other selectively deployable airfoil mechanism are deployed to change the trajectory of the shell 100. Retractable airfoil flaps 103 are shown as extending from slots 105 (behind flaps).

Figure 2:
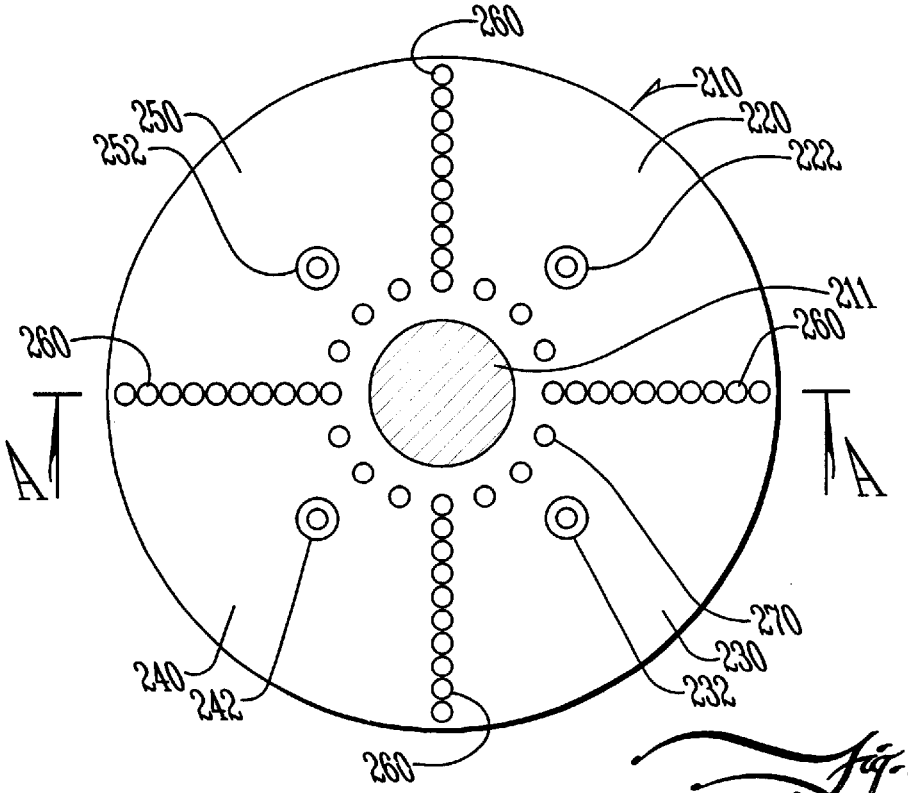
FIG. 2 is a plan view of an antenna array of the present invention, with a centrally disposed actuator pin.

Now referring to FIG. 2, there is shown a top view of an antenna array 210 of the present invention, including a centrally disposed airfoil actuator pin 211, a first antenna element 220, a second antenna element 230, a third antenna element 240 and a fourth antenna element 250, having disposed therein and showing the top portions of first coaxial feed input 222, second coaxial feed input 232, third coaxial feed input 242, and fourth coaxial feed input 252, respectively. The antenna array is formed from a single dielectric disk having a central hole therein. The disk is divided into separate antenna elements by radiating element separation ground via walls 260, which are plated through holes, which form shorting walls to isolate the neighboring antenna elements from each other. Each antenna element is separated from the central airfoil actuator pin 211 by an inner via ground isolation ring 270, which is similar to radiating element separation ground via wall 260.

Figure 3:
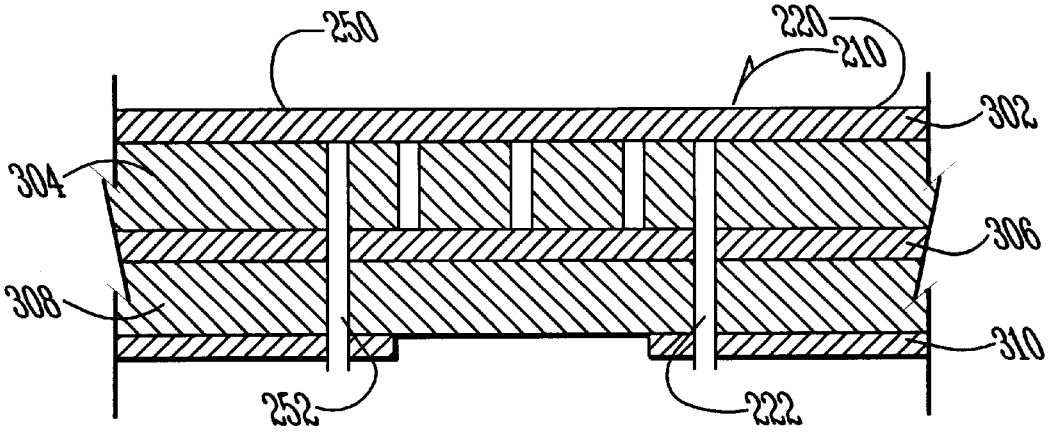
FIG. 3 is a cross-sectional view of the antenna array of the present invention taken on line A—A of FIG. 2.

Now referring to FIG. 3, there is shown a cross-sectional view of the antenna of FIG. 2 taken on line A—A. The antenna array 210 can be clearly seen to have a top ground plane 302, an antenna dielectric 304 in the form of a disk with a central hole therein, a middle ground plane 306, a splitter/combiner dielectric 308 and a micro strip line 310, which can also be strip line. Known techniques of antenna manufacture, design and tuning, etc., such as those used in conjunction with the above-referenced patent application, can be employed to arrive at a particular design for a particular need. Known techniques of impedance matching can be employed in designing and feeding the antenna array 210 of the present invention. First coaxial feed input 222, second coaxial feed input 232 (FIG. 2), third coaxial feed input 242 (FIG. 2), and fourth coaxial feed input 252 may be combined through an impedance matching/power splitter circuit and/or switching circuit. The diameter and location of the coaxial feed inputs within the pie-shaped antenna elements can be adjusted to facilitate impedance matching. Slot aperture coupling between the antenna and the matching/circuit/switch can be used in place of the coax feeds.

An omni-directional mode can be realized when all antenna elements are fed in phase. This can be accomplished with an N way Wilkenson, or equivalent splitter network located on the underside of the antenna array 210. Microstrip line 310 could be a component of such an N way Wilkenson splitter network.

Figure 4:
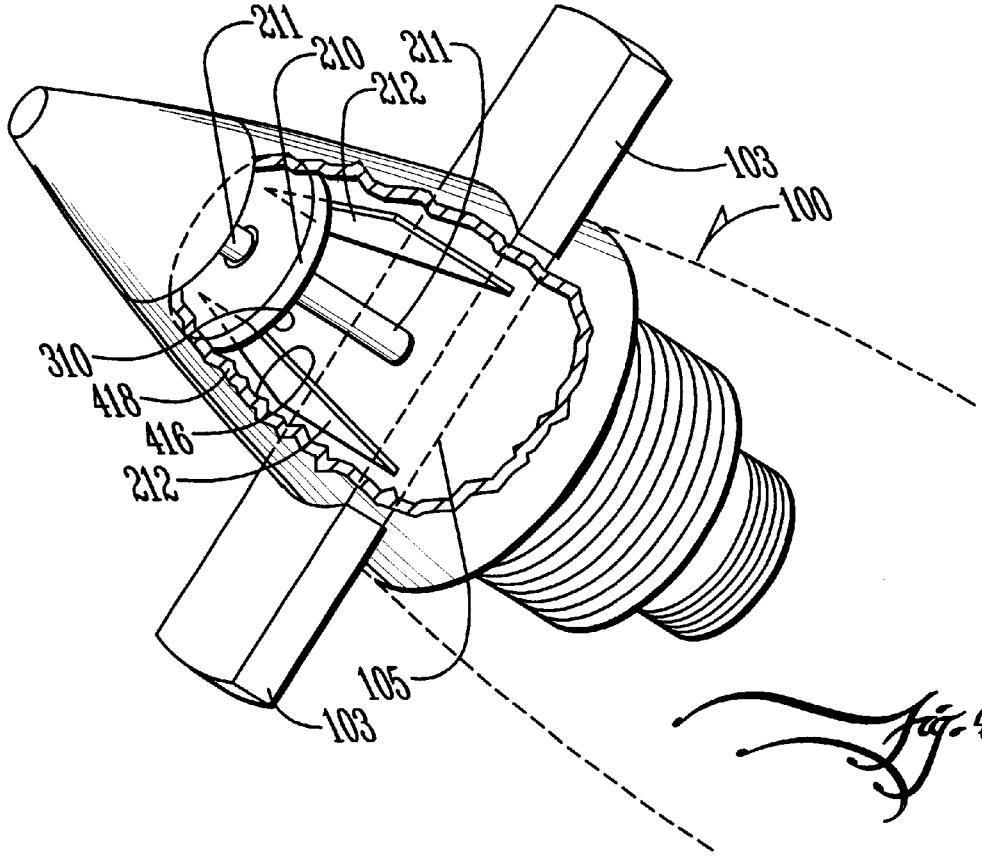
FIG. 4 is a cut-away perspective view of the artillery shell of the present invention.

Antenna array 210 can also be configured with an adjustable switching network and/or phase shifting network to perform radiation pattern synthesis. This can be done with known techniques employed in electronic circuit board 212 (FIG. 4). The number of antenna elements is shown here as being four, but other numbers can be used as well. If lesser numbers of elements are arrayed together, for example 2 elements, a directional pattern perpendicular to the artillery shell 100 fuselage can exist. This could be maintained skyward in a non-spinning missile application to reject ground based, or low altitude jammer signals, as well as terrestrial ground noise.

If artillery shell 100 is a spinning shell, the sectoral antenna elements first antenna element 220, second antenna element 230, third antenna element 240, and fourth antenna element 250 could be commutated in synchronous with the rotation rate of the artillery shell 100, such that only upward directed radiating elements would be enabled at any point in the trajectory of the artillery shell 100.

Now referring to FIG. 4, there is shown a partially cut-away view of the artillery shell 100 of the present invention, where the scalloped cut-away line 418 reveals an interior cavity 416 with GPS receiver electronic circuit boards 212 coupled to the antenna array 210 via a perpendicular mating of the antenna combing/splitter assembly's circuit trace layer or microstrip line 310 to the GPS receiver electronic circuit boards 212. Retractable airfoil flaps 103 are shown removed from slots 105. Various types of retractable airfoil flaps 103 could be employed.

Figure 5:
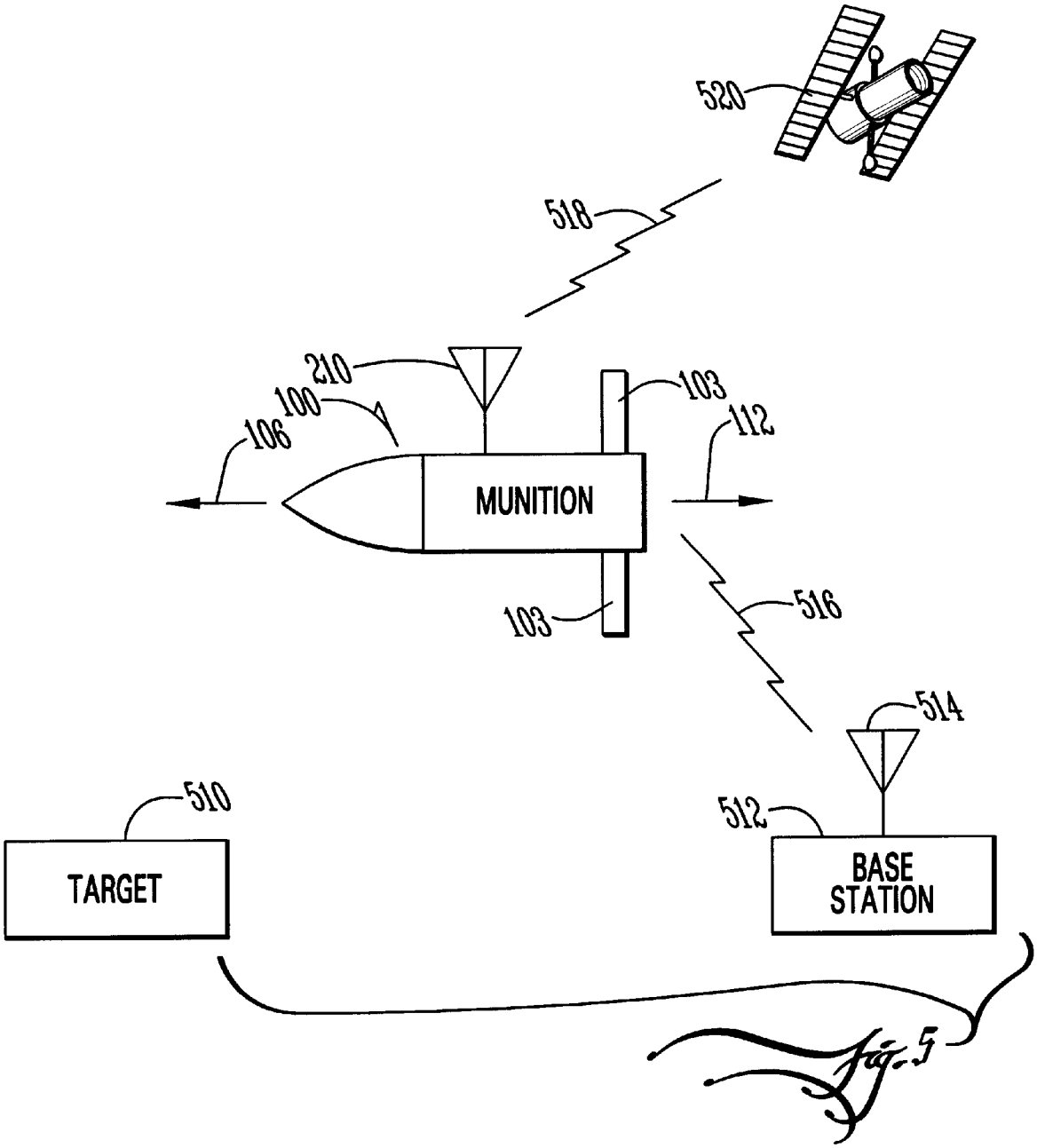
FIG. 5 is a view of the system of the present invention in which the antenna array of the present invention could be used.

Now referring to FIG. 5, there is shown a system of the present invention, which includes an artillery shell 100, which has been launched in a usual manner. Artillery shell 100 is moving in forward direction 106 along a trajectory generally directed toward target 510. Artillery shell 100 has come from a rearward direction 112 along the trajectory. It may be desirable to change the trajectory of artillery shell 100 while in flight to assure proper interaction with target 510. Artillery shell 100 with its on-board GPS receiver continuously monitors its position via space directed signal 518 from satellite 520. Antenna array 210 receives these GPS or other signals and can make course corrections either locally or via telemetry and other communications with base station 512, through terrestrial RF signal 516, and base station antenna 514. A command may be sent to artillery shell 100 to deploy its retractable airfoil flaps 103 so as to change the aerodynamics, speed, and, therefore, trajectory. Other signals, such as detonation commands for airborne detonation, could be sent as well.

Throughout this description, reference is made to a four element antenna array because it is believed that the beneficial aspects of the present invention would be most readily apparent when used in connection with a spinning artillery shell 100 using GPS; however, it should be understood that the present invention is not intended to be limited to four element antenna arrays, spinning artillery shells, or use with GPS and should be hereby construed to include other designs as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. An artillery shell comprising:

a payload;

a guidance system including a radio receiver;

an antenna array coupled to the radio receiver, where the antenna array is a multi-element antenna array having a plurality of individual antenna elements with a central open region therebetween;

the antenna array being configured as a slot antenna;

said central open region being adapted and configured for receiving therein a mechanical actuating pin therein; and said central open region further being free from a coaxial input therein.

2. An artillery shell of claim 1 wherein said multi-element antenna array is formed by using a plurality of plated through holes to form shorting walls between individual antenna elements.

3. An artillery shell of claim 1 wherein said each of said individual antenna elements is fed in phase with respect to each other, and an omni-directional radiation pattern is generated for the antenna array.

4. An artillery shell comprising:

a payload;

a guidance system including a radio receiver;

an antenna array coupled to the radio receiver, where the antenna array is a multi-element antenna array having a plurality of individual antenna elements with a central open region therebetween;

the antenna array being configured as a slot antenna;

wherein said individual elements are fed by signals which are not in-phase, and are fed in accordance with a predetermined scheme; and wherein said predetermined scheme is based on a predetermined scheme of switching between individual antenna elements.

5. An artillery shell of claim 4 wherein said predetermined scheme of switching between individual antenna elements is related to a rotation rate characteristic of the artillery shell during flight.

6. An artillery shell of claim 5 wherein a radiation pattern from said antenna array is predominantly directed in an upward direction.

7. An artillery shell of claim 6 wherein said array includes an inner via ground isolation ring made of plated through holes.

8. An artillery shell of claim 7 further comprising a splitting network disposed on said antenna array.

9. An artillery shell of claim 8 wherein said splitting network includes a line disposed on a surface of said antenna array.

10. An artillery shell of claim 9 further having a first coaxial feed input disposed in a first antenna element and coupled through a plated through hole to line.

11. An artillery shell of claim 10 wherein said splitting network is separated from a middle ground plane of said antenna array by a splitter/combiner dielectric.

12. An artillery shell of claim 11 wherein said antenna array includes four individual antenna elements.

13. An artillery shell of claim 11 wherein said receiver is a GPS receiver.

14. An antenna of claim 13 further comprising a transmitter/receiver/antenna assembly for communicating commands to effect changes in a trajectory of said artillery shell.

15. An artillery shell of claim 14 further comprising retractable airfoil flaps disposed in slots in said artillery shell, where said retractable airfoil flaps are selectively deployable in response to reception of a command from a terrestrial base station.

16. An artillery shell of claim 9 further having a first feed input disposed in a first antenna element which is aperture slot coupled between the line and the antenna.

17. An artillery shell of claim 9 wherein said line is a microstrip line.

18. An artillery shell of claim 9 wherein said line is a strip line.

19. An antenna comprising:

a printed circumferential GPS slot type array of individual antenna elements;

wherein an access hole is centrally disposed between the individual antenna elements;

wherein said access hole is sized, adapted and configured for receiving therein a mechanical actuation pin therein;

the individual antenna elements being separated from each other by shorting walls comprised of a plurality of plated through holes; and, an inner via ground isolation ring disposed around the access hole to provide isolation of the antenna from any mechanical actuation pin disposed in said access hole.

20. An antenna of claim 19 having a splitting network disposed thereon and separated from a middle ground plane by a splitter/combiner dielectric.

21. A method of controlling an artillery shell comprising the steps of:

using an antenna array to monitor GPS satellites and determining a position of the artillery shell during a flight;

providing a command to change a trajectory path characteristic of the flight;

manipulating signals fed to a plurality of independent antenna elements in the antenna array, so as to shape a resulting radiation pattern from said antenna array so that a higher gain characteristic applies to an upwardly directed portion of said radiation pattern; and, deploying airfoils from the artillery shell to change a velocity characteristic of the artillery shell during flight in response to the command.

22. A method of claim 21 wherein said step of manipulating signals fed includes switching signals between the independent antenna elements in a sequence and at a rate which is dependent upon rotational characteristics of the artillery shell during flight;

said step of deploying airfoils is accomplished by moving an airfoil actuator pin disposed in an access hole disposed in said antenna array and between the antenna elements; and, said antenna array being formed by providing shorting walls in a ground plane clad dielectric disk, where the shorting walls are formed by a plurality of adjacent plated through holes.

* * * * *